US005547445A

United States Patent [19]

Chang

[11] Patent Number: 5,547,445

[45] Date of Patent: Aug. 20, 1996

[54] WEIGHTING DEVICE FOR EXERCISE PURPOSES

[76] Inventor: Sreter Chang, No. 451, Ta Tien Road, Homei Chen, Chang Hua Hsien, Taiwan

[21] Appl. No.: 438,269

[22] Filed: May 10, 1995

[51] Int. Cl.[6] ..... A63B 21/00

[52] U.S. Cl. ..... 482/105; 482/93

[58] Field of Search ..... 2/308, 44, 45, 2/92, 312, 322, 315–318; 405/186; 482/105

[56] References Cited

U.S. PATENT DOCUMENTS 5,076,575 12/1991 Eylander ..... 405/186

5,432,951 7/1995 Yewer, Jr. ..... 2/44

*Primary Examiner*—Jerome Donnelly

*Attorney, Agent, or Firm*—Beveridge, DeGrandi, Weilacher & Young LLP

[57] ABSTRACT

A weighting device includes one belt engaged onto a user for exercise purposes and includes a number of pockets formed on the belt for receiving a number of weight members. Another belt has a middle portion secured to the middle portion of the previous belt and is engaged to the previous belt so as to force the weight members toward the users and so as to firmly retain the weight members in the pockets. The weight members may thus be prevented from moving relative to the users.

3 Claims, 3 Drawing Sheets

WEIGHTING DEVICE FOR EXERCISE PURPOSES

BACKGROUND OF THE INVENTION

1. Field of the Invention

The present invention relates to a weighting device, and more particularly to a weighting device for exercise purposes.

2. Description of the Prior Art

A typical weighting device for exercise purposes is shown in FIG. 1 and comprises a sleeveless garment 4 including one or more pockets 41 for receiving weighting means 5 therein and including a panel 42 secured to the pockets 41 by hook and loop devices 43 so as to retain the weighting means 5 within the pockets 41. However, when the users are jogging, the weighting means 5 may not be solidly secured to the users and may move relative to the users, such that the users, particularly the shoulders thereof, may be hurt by the weighting means.

The present invention has arisen to mitigate and/or obviate the afore-described disadvantages of the conventional weighting devices.

SUMMARY OF THE INVENTION

The primary objective of the present invention is to provide a weighting device which may be solidly secured to the users.

In accordance with one aspect of the invention, there is provided a weighting device for engaging onto a user and for exercise purposes. The weighting device comprises a first belt including a middle portion and two end portions and including an outer surface having a plurality of pockets provided thereon, a first engaging means secured to the end portions of the first belt so as to secure the end portions of the first belt together and so as to attach the first belt to the user, weight members engaged in the pockets, a second belt including a middle portion secured to the middle portion of the first belt and including two end portions, and a second engaging means secured to the end portions of the second belt so as to engage the second belt to the first belt and so as to force the weight members and so as to solidly retain the weight members in the pockets. The weight members may be solidly secured to the users and may be prevented from moving relative to the users.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
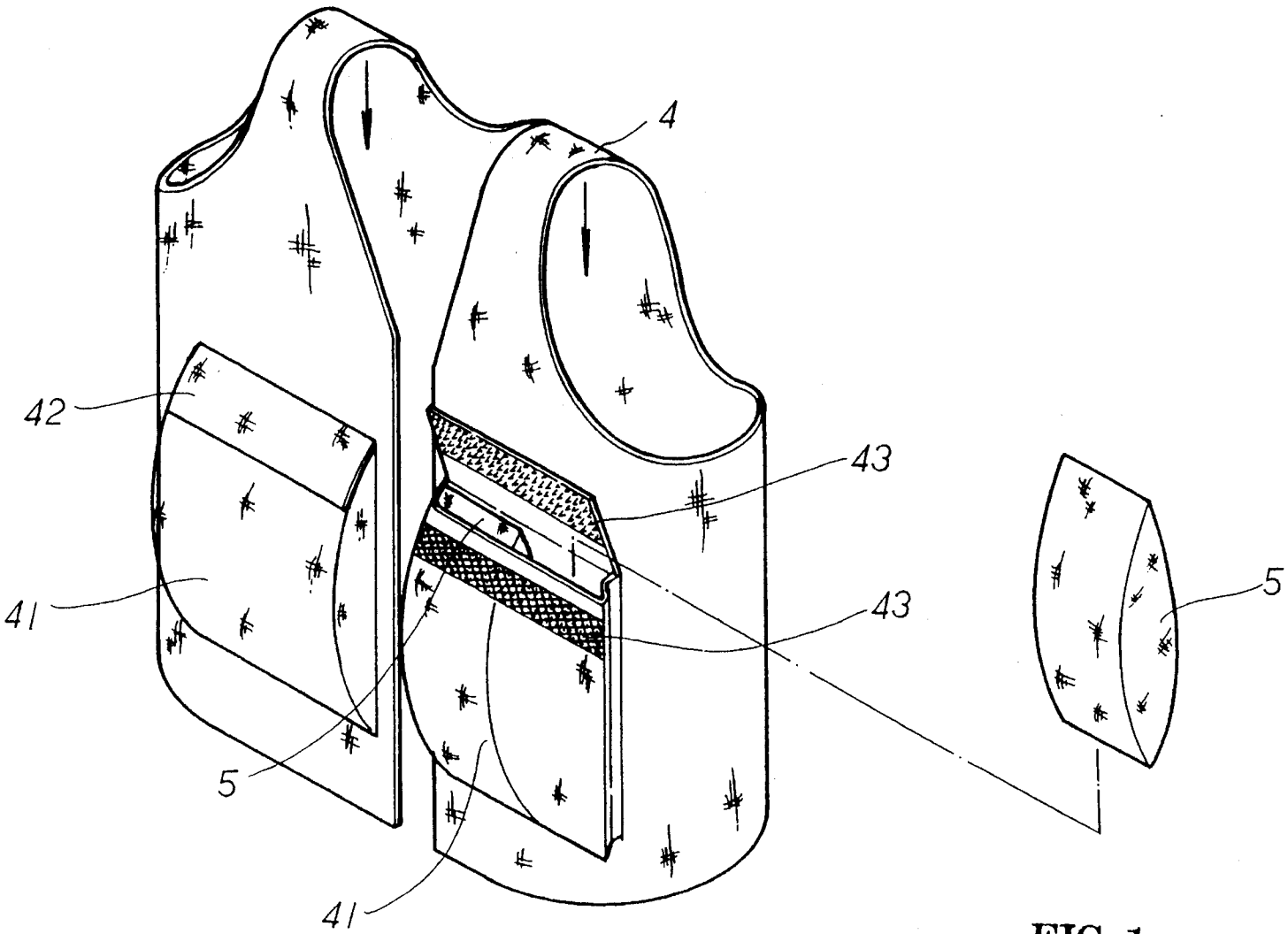
FIG 1 PRIOR ART
FIG. 1 is a perspective view of a typical weighting device.
Figure 2:
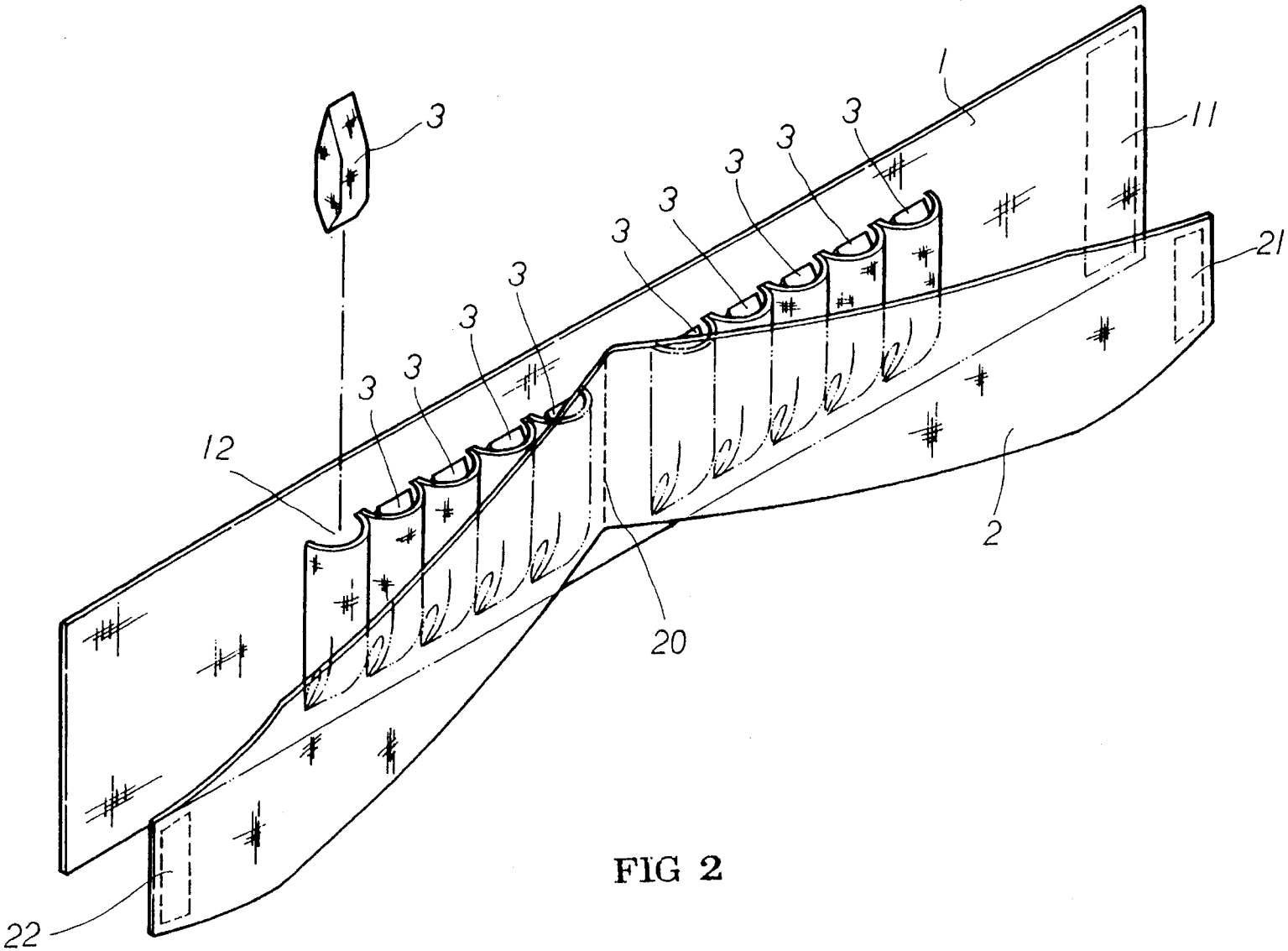
FIG. 2 is a perspective view of a weighting device in accordance with the present invention.

Referring to the drawings, and initially to FIG. 2, a weighting device in accordance with the present invention comprises a first belt 1 for engaging onto the users, particularly the waist portion of the users. The first belt 1 includes a hook and loop device 11 provided in the end portions for securing the end portions of the first belt together so as to attach the first best to the waist portion of the users, and includes an outer surface having a number of pockets 12 provided thereon for receiving weight members 3 therein. A second belt 2 includes a middle portion secured to the middle portion of the first belt 1 by such as stitches 20 and includes two end portions each having a hook and loop device 2, 22 provided thereon for engaging with the belts 1 and 2.

Figure 4:
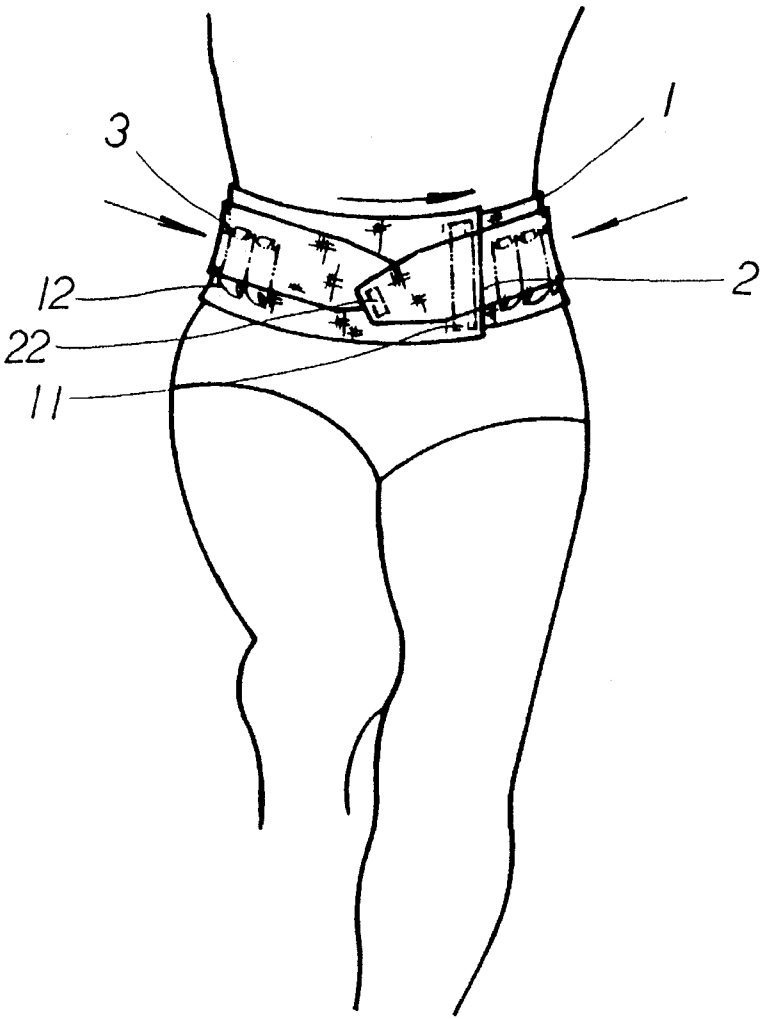
FIGS. 3 and 4 are schematic views illustrating the application of the weighting device.
Figure 3:
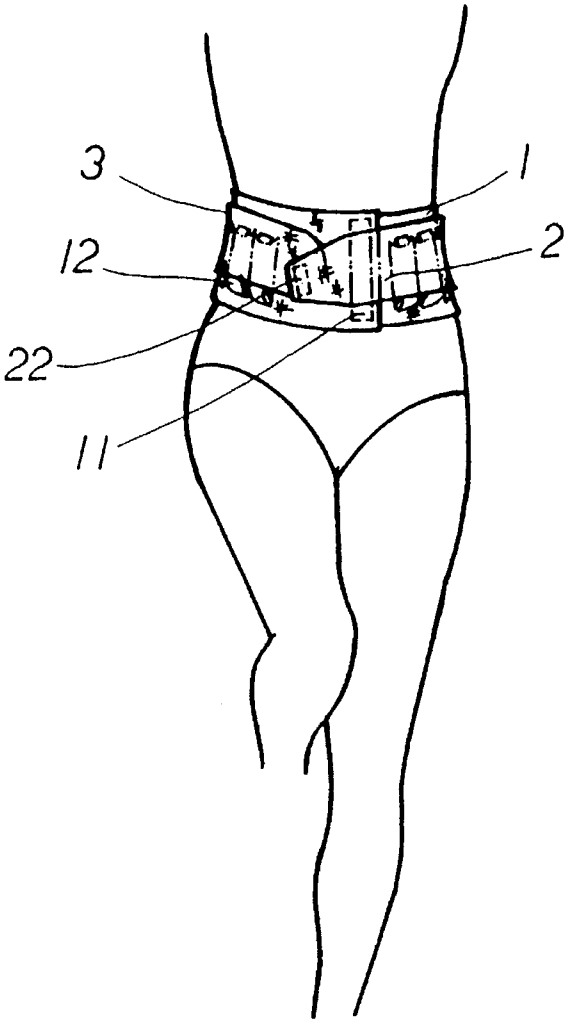

Referring next to FIGS. 3 and 4, it is preferable that the belts and 2 are resilient so as to be attached to the users of various kind of sizes. The second belt 2 may further secure the weight members 3 to the users and may apply a force against the first belt 1 and the weight members 3 so as to solidly retain the weight members 3 within the pockets 12.

Accordingly, the weighting device in accordance with the present invention may be solidly secured to the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A weighted exercise belt, comprising:

a first belt having a middle portion, a first end portion and a second end portion;

a plurality of open pockets disposed on said first belt, for housing a plurality of weighted members;

first means for fastening said first belt having two mutually engageable fastening parts, one of said fastening parts disposed on said first end portion of said first belt and the other of said fastening parts disposed on said second end portion of said first belt;

a second belt having a middle portion, a first end portion and a second end portion, said middle portion of said second belt being fixed to said first belt; and a second means for fastening said second belt having two mutually engageable fastening parts, one of said fastening parts being disposed on said first end portion of said second belt and the other of said fastening parts disposed on said second end portion of said second belt; wherein:

when said first end and said second end of said second belt are coupled by said second fastening means, said second belt substantially covers the openings of said pockets and applies pressure to the plurality of weighted members within said pockets thereby prohibiting undesired movement of said plurality of weighted members.

2. A weighted exercise belt as recited in claim 1, wherein:

said middle portion of said second belt is attached to said middle portion of said first belt.

3. A weighted exercise belt as recited in claim 1, wherein:

said plurality of pockets are disposed in a single row on said first belt and said second belt substantially covers said pockets and the openings in the pockets.

* * * * *